United States Patent [19]

Merrill et al.

[11] Patent Number: 5,004,246

[45] Date of Patent: Apr. 2, 1991

[54] INTERNATIONAL WHITE-WATER RAFTING GAME

[76] Inventors: Frances S. Merrill, 214 Archers Mead, Williamsburg, Va. 23185; Richard L. Miller; Patricia M. Miller, both of Rte. 3, Box 1063, Hayes, Va. 23072

[21] Appl. No.: 576,785

[22] Filed: Sep. 4, 1990

[51] Int. Cl.[5] ..... A63F 3/00; A63F 9/14

[52] U.S. Cl. ..... 273/246; 273/251; 273/287; 273/86 C

[58] Field of Search ..... 273/246, 249, 251, 252, 273/254, 276, 287, 16 A, 1 G, 86 C, 86 D

[56] References Cited

U.S. PATENT DOCUMENTS

| | | | |
|---|---|---|---|
| 2,572,412 | 10/1951 | Wharton | 273/246 |
| 3,298,692 | 1/1967 | Glass et al. | 273/276 |
| 3,464,702 | 9/1969 | Stan | 273/243 |
| 3,735,986 | 5/1973 | Glass et al. | 273/249 |
| 3,754,763 | 8/1973 | Breslow | 273/287 |
| 3,921,981 | 11/1975 | Ashburn | 273/244 |
| 3,985,361 | 10/1976 | Millen | 273/250 |
| 4,062,545 | 12/1976 | Witney | 273/246 |
| 4,081,183 | 3/1978 | Urban | 273/249 |
| 4,128,296 | 12/1978 | Hicks | 273/243 |
| 4,290,608 | 9/1981 | Brown | 273/256 |
| 4,333,655 | 6/1982 | Rudell | 273/241 |
| 4,357,017 | 11/1982 | Schneider | 273/246 |
| 4,563,011 | 1/1986 | Ferris | 273/243 |
| 4,834,387 | 5/1989 | Coffman | 273/252 |
| 4,949,975 | 8/1990 | Carrier | 273/251 |

*Primary Examiner*—Benjamin Layno

*Attorney, Agent, or Firm*—Wallace J. Nelson

[57] ABSTRACT

A board game for simulating a white-water rafting course wherein two or more players attempt to be the first to reach the finish line. A game board is utilized that depicts a white water stream divided into a plurality of spaces with game pieces in the form of rafts being moved along the spaces according to the roll of a single die. Various spaces on the course have instructions for further action by the player and include picking a card from a deck of pick cards with additional instructions. A three-dimensional HO scale railroad segment and flat car serve as the launch mechanism for each game piece. Each player selects a flag representing the nation of his choice for the race and installs this flag on his raft game piece prior to launch thereof. Hazards on the white-water cource include a three-dimensional drawbridge that must be manually opened by each player and a three-dimensional portage route that may be traversed, depending upon the roll of the die.

14 Claims, 1 Drawing Sheet

INTERNATIONAL WHITE-WATER RAFTING GAME

FIELD OF THE INVENTION

This invention relates generally to board games and relates specifically to a board game depicting a white-water raft course wherein two or more competing players attempt to be the first to reach the pick-up point.

BACKGROUND OF THE INVENTION

Board games for two or more competing players based on road trips, mountain trails, various sports events, and the like, are well known in the art. No board games are known, however, that depict the adventure, skill and chance involved in white-water rafting.

Accordingly, it is an object of the present invention to provide a board game that depicts a challenging white-water course raceway.

Another object of the present invention is a board game that is easy to understand and operate, yet challenging to a varied age group of players.

A further object of the present invention is a board game for two or more players that is entertaining and exciting to the participants.

An additional object of the present invention is a board game depicting a white-water course for two or more players with the winner of the game being determined primarily by chance.

A further object of the present invention is a board game depicting a white-water raft raceway that is educational in identifying and exposing the novice to simulated hazards that may be encountered in a real white-water raft trip.

SUMMARY OF THE INVENTION

According to the present invention, the foregoing and additional objects are attained by providing a board game including a game board having a plurality of spaced lines, disposed over a graphic representation of a waterway and, dividing the waterway into a plurality of spaces. The waterway and the surrounding scenery on the game board are realistically painted to include rocks, white-water rapids, water falls, and the like, with mountainous terrain including trees and clear areas surrounding the waterway. A three-dimensional equipment lodge and a ready ramp area are provided on the game board with a plurality of game pieces in the shape of water rafts being disposed on the ready ramp.

An HO scale railroad segment is attached to the game board adjacent to the ready ramp and a flat rail car provided on the rail segment. A plurality of miniature flags representing various nations of the world are releasably retained along a edge of the ready ramp with each of the two-four, or more, game players choosing the flag of his choice for display on his game piece. Each game piece has a flag retention base thereon to receive the staff of the flag chosen. Each raft game piece is individually placed on the flat rail car by the player and the car manually pushed along the rail segment toward the waterway. As the rail car reaches an inclined area on the rail segment, the car is released by the player and continues movement due to gravitational forces toward the waterway. A vertical barrier at the end of the rail segment stops the rail car and the sudden stop causes the momentum of the raft game piece carried by the car to slide off the rail car and over the barrier to land at a bowman push-off point on the waterway.

After each player launches his raft game piece, the players sequentially roll a die to determine the number of spaces to move their respective game pieces along the gridwork of the depicted waterway. Selected spaces on the waterway course are blank or free spaces while others carry instructions for further action by the player. These instructions may include further advancing of the game piece, retreating of the game piece, selection of a card from a pick card deck for further instructions, and the like.

A three-dimensional tent camp area and a three-dimensional drawbridge are disposed along the waterway. Printed instructions on the pick cards, and/or on the spaces landed on, control the use of these features. Also, a three-dimensional portage route is provided over a portion of the waterway and, depending upon the chance of the die roll, and/or the space and pick-card instructions, the player may have to traverse the portage route with his game piece. The first player to reach or pass the pick-up space at the end of the depicted waterway is the winner with the game continuing by the other players to determine the order of finish for all.

BRIEF DESCRIPTION OF THE DRAWINGS

A more complete appreciation of the invention and many of the attendant advantages thereof will become more readily apparent as the same becomes better understood by reference to the following detailed description when considered in connection with the accompanying drawings wherein.

DETAILED DESCRIPTION

Figure 1:
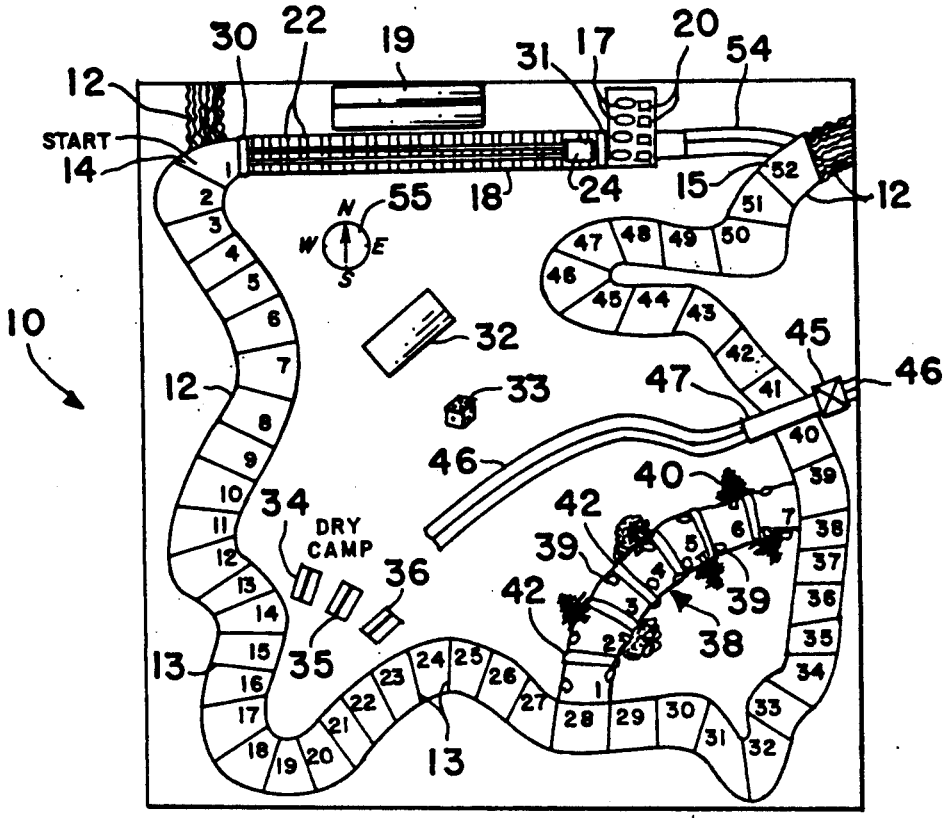
FIG. 1 is a plan view of the game board and accessories of the present invention.

Referring now to the drawings, and more particularly to FIG. 1, there is shown a game board designated generally by reference numeral 10 having a graphic representation of a fast flowing waterway 12 thereon following a curveous path through an area graphically representing mountainous terrain. Waterway 12 includes graphic representations of water rapids, water falls and other hazards along its route. Waterway 12 is divided by a plurality of lines 13 into a plurality of substantially equal sized spaces. The length of waterway 12 shown includes a bowman push-off start space 14 and a pick-up finish line space 15. Between bowman push-off space 14 and pick-up space 15, the remaining spaces constitute obstacle free spaces, pick card spaces, or obstacle spaces, as will be further explained hereinafter. When landing on obstacle free spaces no further action is required by the player. When landing on a pick card space or obstacle space, the player must do as directed on the pick card or as printed on the space. In addition, all players must stop on space 40, regardless of the previous roll of die 33, lose one turn, and open drawbridge to proceed.

A plurality of game pieces 17 in the shape of water rafts are disposed on a ready ramp 18 adjacent an equipment lodge 19. Ready ramp 18 is formed of the short leg of an L-shaped balsa wood or plastics strip. A plurality of miniature flags 20 are attached to individual staffs (not designated) and removably positioned along the length of ready ramp 18. Flags 20 are replicas of various nations of the world and typically include the United States, USSR, Great Britain, Canada, Switzerland, West Germany, Japan, Australia, Norway, and Brazil. Other miniature flags representing other world nations may be employed as so desired. Only four miniature flags are illustrated in the drawings for purposes of clarity, whereas the actual game board has space to display ten flags. The game board kit may include miniature flags from all of the nations belonging to the United Nations, as well as the fifty state flags of the United States. Each game piece has an opening therein serving to receive the staff of one of the miniature flags.

Figure 2:
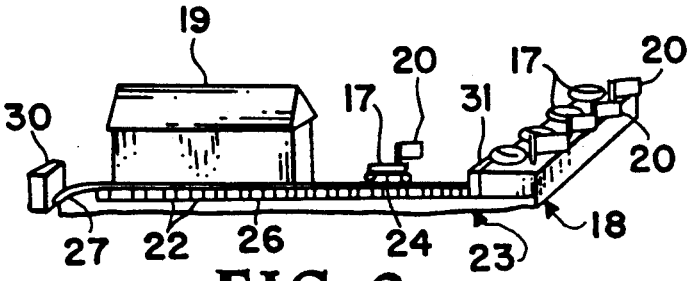
FIG. 2 is an enlarged view of the equipment lodge area including the ready ramp, railroad segment, flat car, rafts, flags, and car barriers.

An HO scale railroad segment 22 is provided on and supported by an angular extension 23 (the long leg of the L-shaped strip) of ready ramp 18. An HO scale railroad flat car 24 is positioned on railroad segment 22. Flat car 24 supports an individual water raft game piece 17 and serves to transport the game piece 17 from ready ramp 18 to bowman start space 14. A vertical barrier is disposed at each end of railroad segment 22 to restrict the movement of railroad flat car 24 therebetween, as designated by reference numerals 30 and 31. As shown more clearly in FIG. 2, angular extension 23, serving as the road bed for railroad segment 22, is provided with a top surface having a first length 26 adjacent ready ramp 18 that is parallel with and spaced from the surface of game board 10. A second length 27 of the road bed surface for railroad segment 22 inclines from the first length 26 toward the surface of game board 10 and terminates at a vertical barrier wall 30 adjacent bowman push-off space 14, as will be further explained hereinafter.

A deck of pick-cards 32 is placed face down on board 10, the function of which will be further explained hereinafter. Also illustrated in FIG. 1 is a single die 33 that is used by each game player to determine the moves for his game piece, as will also be further explained hereinafter.

Figure 3:
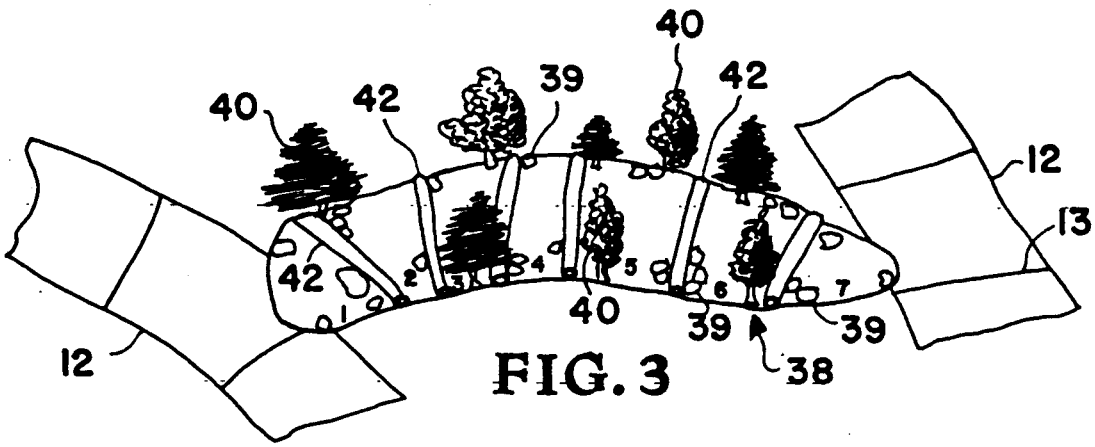
FIG. 3 is an enlarged perspective view of the three-dimensional portage obstacle segment.

A dry camp area including three tents designated by reference numerals 34, 35, and 36 are disposed adjacent waterway 12. A three-dimensional portage obstacle path, designated by reference numeral 38, is disposed adjacent to and between ends of a bend in waterway 12. As shown more clearly in FIG. 3, portage obstacle path 38 simulates mountainous terrain and includes rocks or boulders 39 and trees 40. Three-dimensional simulated fallen logs 42 serve as the dividing lines between the seven spaces on portage path 38.

Figure 4:
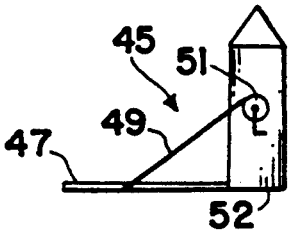
FIG. 4 is a perspective view of the three-dimensional draw bridge assembly.

A three-dimensional bascule type drawbridge 45 is provided over waterway 12 downstream from portage obstacle path 38. Drawbridge 45 spans waterway 12 and is in alignment with a simulated roadway 46 on game board 10. As shown more clearly in FIG. 4, drawbridge 45 includes a draw span 47 serving as the bridge continuation for roadway 46. Cables 49 are secured at one end to draw span 47 and the other ends thereof attached to a pulley or windless 51 extending through tower 52 to permit manual turning thereof and wind cables 49 therearound to raise draw span 47.

A second roadway 54 is graphically illustrated on game board 10 and serves to connect the pick-up finish line space 15 to equipment lodge 19 area to simulate a route for returning the water rafts to the lodge after completion of their journey.

The object of the game is to be the first of two or more players to complete the white water raft trip and arrive at pick-up space 15.

The equipment used to play the game, in the preferred embodiment, includes a twenty-four by twenty-seven inch game board 10; four balsa wood raft game pieces 17; a deck of appropriately labeled pick-cards 32; a single die 33; three simulated tents 34,35,36 (formed of balsa wood or lightweight plastic); ten miniature flags 20 with staffs (only four illustrated for purposes of clarity); an equipment lodge building 19; a length of HO scale railroad 22 attached to an L-shaped balsa wood strip 18,23 that also serves as the ready ramp for the game pieces; an HO scale flat car 24; vertical end barriers 30,31 at each end of the railroad segment to confine the movement of the flat car therebetween; a three-dimensional portage obstacle course 38; and, a three-dimensional drawbridge assembly 45. Suitable base slip clips (not shown) are also provided to releasably secure or attach the equipment lodge building, the L-shaped balsa wood strip, drawbridge and portage obstacle course to the game board. For packaging, the game board 10 is folded once and, along with all accessories suitably boxed or bagged, and stored in a suitable decorative cardboard box.

In operation, game board 10 is placed on a flat surface and equipment lodge building 19 and the L-shaped balsa wood strip, with attached railroad segment 22, are positioned, and selectively attached, to the game board adjacent to the area thereon designated as the bowman push-off start point 14. The game pieces 17 are placed on the short leg of the L-shaped wood strip (ready ramp 18) and the staffs of ten miniature flags 20 inserted in the row of equally spaced holes provided thereon. The three tents 34, 35, and 36 are placed on the board adjacent the simulated waterway at the place designated "Dry Camp"; the portage obstacle course 38 is positioned, and selectively attached, to the board where designated to connect with the ends of a bend in the waterway; and the three-dimensional drawbridge 45 is positioned, and selectively attached, to the board at the designated position. The deck of pick-cards 32 are shuffled or mixed and placed face down on the board, where designated, and the game is ready for play. The players, two or more, select their game pieces and a miniature flag representing the nation of their choice and install this flag on their game piece.

The sequence of play for the players is determined by a roll of die 33 by each player. The first player places his game piece on flat car 24 and manually pushes the flat car toward bowman push-off start point 14. As car 24 reaches the incline area 27 on railroad segment 22, the player releases the car and permits gravity to continue the movement thereof. When the car strikes end barrier 30 on the railroad segment, flat car 24 is abruptly stopped but the momentum of the game piece carried thereby causes it to slide off the flat car over barrier 30 and land on bowman push-off space 14 on waterway 12. This is repeated by each player until each water raft game piece is launched and the water raft trip begins. The first player rolls die 33 and manually moves his game piece 17 the number of spaces designated by the die number displayed.

As mentioned hereinbefore, the spaces between bowman push-off space 14 and pick-up finish line space 15 are divided into obstacle free spaces, pick card spaces and obstacle spaces. When landing on an obstacle free space no further action is required by the player, but when landing on a pick card or obstacle space the player must do as directed. The legends for each space are omitted in the drawings for purposes of clarity. Also, all players must stop on space 40, regardless of the previous roll of the die, and lose one turn before proceeding to open the drawbridge. The obstacle free spaces are 1 (bowman push-off space), 2, 3, 5, 7, 10, 13, 15, 16, 17, 19, 21, 22, 24, 25, 26, 32, 34, 35, 36, 38, 39, 42, 43, 44, 45, 46, 49, 50, 51, and 52 (pick-up finish line space). Pick-up finish line space 52 is provided with a painting of a truck holding rafts. The "pick card" spaces are 4, 8, 14, 18, 23, 28, 33, 37, 41, and 47. Also, on the portage obstacle route, the only additional obstacle is a "pick card" found at space 3 (of the 7 spaces).

The following obstacle spaces are provided on waterway 12 with instructions printed thereon as follows:

#6—Caught in whirlpool, lose 1 turn
#9—Go to dry camp, lose one turn, reenter at #16
#11—Safe over falls, advance 3 spaces
#12—Boatman overboard, lose 1 turn (waterfall painted on space)
#20—Repair leaky raft, lose 1 turn
#27—Go by way of portage
#29—Confused currents, go back 2 spaces
#30—Stop, must roll even # to pass through gorge
#31—Go back to #30
#40—Lose 1 turn
#48—Repair broken rudder lose 1 turn The deck of "Pick Cards" contains 30 cards with the number of cards and their individual instructions as follows:

3—Advance 1 space
3—Advance 2 spaces
3—Advance 3 spaces
2—Go back 1 space
2—Go back 2 spaces
2—Go back 3 spaces
2—Ticket to open bridge
2—Hung up on Sleeper rock, lose one turn
2—Enter surge, advance 1 space
1—River channel, advance 1 space
1—Time for lunch and rest
1—Never float alone-Never float unknown
1—Release buddy raft, advance 1 space
1—Trapped, breaking hole, lose 1 turn
1—You have just avoided roller waves
1—Raft too small to handle chutes, go back 1 space
1—Raft fills with water, lose gear and 1 turn
1—Go to dry camp-lose turn-reenter at #16

The portage area 38 is approximately nine and one-half inches long, has a varied width and is approximately one and one-half inches high at the highest point. The portage area insert is a three-dimensional model representing mountainous terrain with random rocks and trees thereon. There are seven spaces on the portage route with simulated fallen timbers serving as the dividing lines therefor with space 3 thereon being a "pick card" space. The remaining six spaces on the portage route are obstacle free spaces.

Conventional base slip clips (not shown) are provided to selectively attach equipment lodge 19, the L-shaped balsa wood strip 18,23, portage area 38 and drawbridge 45 to game board 10. These pieces of equipment may remain unattached if desired, or if the game board is not to be moved during play.

Drawbridge 45 includes a unitary bridge base and tower building having a height of approximately three inches with draw span 47 being approximately six inches long and one inch wide. Specific dimensions have not been given for all of the various components of the invention described herein, it being understood that such may vary slightly as long as they are compatible for operation of the invention as described.

As mentioned hereinbefore, game board 10 is painted or printed to depict scenery showing wood, rocks and water and all of which are not completely illustrated herein in the interest of clarity. Also roadway 46 and the NSEW directional mark 55 are painted on game board 10.

Although the invention has been described relative to a specific embodiment thereof, it is not so limited and there are numerous variations and modifications thereof that will be readily apparent to those skilled in the art in the light of the above teachings. For example, although balsa wood is the preferred material for constructing the equipment lodge, game pieces, tents, drawbridge, and portions of the portage area for minimum weight, obviously these and other components may be constructed from suitable lightweight plastics without departing from the spirit and scope of the present invention.

It is therefore to be understood that within the scope of the appended claims, the invention may be practiced other than as specifically described herein.

What is claimed as new and desired to be secured by Letters Patent of the United States is:

1. A board game for at least two players comprising:

a game board having a plurality of spaced lines disposed over a graphic representation of a waterway and dividing said waterway into a plurality of spaces;

said waterway simulating a fast flowing stream including white water rapids, water falls, and other hazards and including a bowman push-off start space and a pick-up area finish line space;

a plurality of game pieces in the shape of water rafts for manual movement along the waterway and positionable in the spaces between said spaced lines;

an equipment lodge and a ready ramp area on said game board for said plurality of game pieces;

a plurality of individual miniature flags representing various entities releasably displayed along said ready ramp area for said game pieces;

means on each said game piece to releasably receive and display one of said miniature flags;

a miniature railroad segment disposed on said game board adjacent said equipment lodge;

said miniature railroad segment having a first length on a relatively level plane parallel with said game board and leading from said ready ramp area to a second length of said railroad segment;

said second length of said railroad segment being on an inclined plane extending from said first length and terminating at a raft site on said waterway;

a miniature flat bed rail car disposed on said railroad segment and adapted to transport an individual game piece from said ready ramp area to said raft launch site;

a barrier wall disposed at the end of said second length of said railroad segment and adjacent said launch site, whereby, a game player selects his raft game piece from said ready ramp area, displays the nation flag of his choice thereon, places the raft game piece onto said flat bed rail car and moves said car toward said launch site, and when said rail car reaches said second length of said railroad segment, said inclined plane for said second length promotes gravity acceleration of said rail car and when said rail car strikes said barrier wall, said raft game piece will be gravity launched from said rail car over said barrier wall onto said waterway at said bowman push-off starting space.

2. The board game of claim 1 including a three-dimensional drawbridge structure disposed over a portion of said waterway and manual operating means for raising and lowering of said drawbridge by a game player.

3. The board game of claim 1 including:

a die that is rolled by each player to determine the number of spaces to move his game piece;

a deck of pick cards positioned face down on said game board;

selected spaces between said spaced lines having instructions thereon requiring the player to select a card from said pick card deck; and each card in said pick card deck containing further instructions for the player relative to movement of his game piece.

4. The board game of claim 3 including a dry camp area containing a plurality of three-dimensional tents disposed on said game board and a portage obstacle path disposed adjacent to and between ends of a bend in said waterway.

5. The board game of claim 3 including selected spaces between said spaced lines having instructions for additional movement of the game piece landing thereon.

6. The board game of claim 5 including at least one of said selected spaces between said spaced lines on said game board having instructions requiring the player to move his game piece by way of said portage obstacle path.

7. The board game of claim 3 wherein said portage obstacle path is a three-dimensional representation of mountainous terrain having rocks and trees thereon and having a plurality of spaces thereon divided by simulated fallen timbers.

8. A board game for at least two players comprising:

a game board having a simulated waterway graphically displayed thereon and divided into a plurality of spaces by a plurality of spaced lines;

said waterway simulating a fast flowing stream having a bowman push-off start space and a pick-up finish line space and including graphic illustrations of white water rapids, water falls, and other hazards;

a plurality of water raft game pieces manually movable along the waterway and positionable in the spaces formed by said plurality of lines;

an equipment lodge and a ready ramp area on said game board for said plurality of game pieces;

a miniature flag representing a nation of the world releasably carried by each said water raft game piece;

means effecting gravity launch of each game piece includes a miniature railroad segment having an incline portion terminating adjacent said bowman push-off start space, a flat car disposed and movable on said railroad segment, a barrier positioned between said bowman push-off start space and said railroad segment to stop movement of said flat car at that point, whereby when a water raft game piece is transported by said flat car and said flat car is stopped by said barrier, the momentum of said game piece carried by said flat car will cause said game piece to be gravity launched over said barrier and onto said game board at the bowman push-off start space; and, means operable by each player determining the number of spaces on said waterway his game piece may be moved at a time.

9. The board game of claim 8 wherein said means operable by each player determining the number of spaces on said water his game piece may be moved at a time includes a die and the roll of the die by the game player indicates the number of spaces to be moved, and selected ones of said spaces having indicia thereon to indicate further movement of the game piece.

10. The board game of claim 8 including a plurality of pick cards disposed on said game board, each one of said plurality of pick cards having further instructions thereon relative to movement of said game piece by the player and selected ones of said spaces having indicia thereon instructing the player to select a pick card at that point.

11. The board game of claim 10 wherein said portage obstacle path is three-dimensional simulated mountainous terrain having simulated trees and rock thereon and including simulated fallen trees serving as lines dividing the portage obstacle path into a plurality of spaces.

12. The board game of claim 8 including a portage obstacle path disposed on said game board between the ends of a bend in said waterway and at least one of said spaces having indicia thereon directing the player arriving at said space to leave the waterway and traverse the portage obstacle path.

13. The board game of claim 8 including a three-dimensional drawbridge extending over a segment of said waterway and selected ones of said spaces and said pick cards having instructions thereon to permit opening of said drawbridge.

14. The board game of claim 13 wherein said drawbridge is provided with a manually operated bridge opening mechanism operable by the individual game players.

* * * * *